US009791229B1

(12) United States Patent
Cross et al.

(10) Patent No.: US 9,791,229 B1
(45) Date of Patent: Oct. 17, 2017

(54) SPRUNG WEAPON PIN SYSTEM

(71) Applicants: Wes Cross, San Diego, CA (US); Mark Blakey, San Diego, CA (US)

(72) Inventors: Wes Cross, San Diego, CA (US); Mark Blakey, San Diego, CA (US)

( * ) Notice: Subject to any disclaimer, the term of this patent is extended or adjusted under 35 U.S.C. 154(b) by 0 days.

(21) Appl. No.: 15/486,619

(22) Filed: Apr. 13, 2017

(51) Int. Cl.
*F41A 11/00* (2006.01)
*F41A 3/66* (2006.01)
*F41A 3/84* (2006.01)

(52) U.S. Cl.
CPC ..... *F41A 11/00* (2013.01); *F41A 3/66* (2013.01); *F41A 3/84* (2013.01)

(58) Field of Classification Search
CPC ..... F41A 11/00; F41A 3/66; F41A 3/84
USPC ..... 42/108, 106, 75.03
See application file for complete search history.

(56) References Cited

U.S. PATENT DOCUMENTS 7,147,420 B2 * 12/2006 Baus ..... F16B 21/125 411/347
7,937,876 B1 * 5/2011 Graham ..... F41A 3/66 42/75.01
9,151,555 B1 * 10/2015 Huang ..... F41A 11/00
9,400,006 B1 * 7/2016 Huang ..... F16B 19/02
2004/0020092 A1 * 2/2004 Christensen ..... F41A 9/70 42/49.01
2010/0229445 A1 * 9/2010 Patel ..... F41A 3/66 42/6
2013/0047482 A1 * 2/2013 Mulfinger ..... F41C 27/00 42/84
2013/0055610 A1 * 3/2013 Watkins ..... F41A 11/04 42/16
2013/0205637 A1 * 8/2013 Patel ..... F41A 3/66 42/75.02
2014/0130392 A1 * 5/2014 Oh ..... F41G 11/003 42/84
2015/0052793 A1 * 2/2015 Cassady ..... F41A 9/61 42/8
2015/0198394 A1 * 7/2015 Hochstrate ..... F41A 3/26 42/17
2015/0260471 A1 * 9/2015 Azhocar ..... F41A 11/00 42/90
2015/0308768 A1 * 10/2015 Mills ..... F41A 11/04 42/75.03
2016/0109198 A1 * 4/2016 Gardner ..... F41A 3/66 411/500
2016/0258697 A1 * 9/2016 Hoon ..... F41A 17/38
2017/0138686 A1 * 5/2017 Hochstrate ..... F41A 3/26

* cited by examiner

*Primary Examiner* — Joshua E Freeman
(74) *Attorney, Agent, or Firm* — Eric Hanscom

(57) ABSTRACT

In broad embodiment, the present invention is a set of sprung pins, operated by paddles, used to facilitate the assembly and disassembly of a firearm.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

20 Claims, 5 Drawing Sheets

SPRUNG WEAPON PIN SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of firearms. More particularly, the present invention is in the technical field of firearm assembly and disassembly. More particularly still, the present invention is in the field of firearm pins, often referred to as takedown pins.

Semi-automatic firearms have been known for a long time. The first semi-automatic rifle was introduced in 1885. The M-16 automatic rifle has been used by the military for years. A civilian version of the M-16 is known as the AR-15 and is a semi-automatic rifle. The AR-15 has been manufactured and sold to civilians for many years. In order to disassemble the weapon, commonly referred to as "breaking down" a weapon, one must remove one or two pins, commonly referred to as takedown pins. One pin is in the front of the weapon, below the barrel and in front of the magazine well, and the other pin is at the rear of the weapon, above the grip and below the charging handle. The present invention is intended to replace the rear takedown pin of the AR-15 and M-16 as well as any other pinned weapon and or weapon system applicable.

SUMMARY OF THE INVENTION

The present invention is a sprung assembly of locking pins, for a firearms upper and lower bodies, operated by placing pressure on paddles to release the upper body from the lower body of a firearm. The present invention also allows for closure of the upper body of a firearm on to the lower body of a firearm, using the pressure of the upper body to move the pins away from its at rest position until the upper and lower bodies are aligned, then the pins fall back to its at-rest position because of their springs, and lock the two bodies together.

DRAWINGS—REFERENCE NUMERALS

Figure 1:
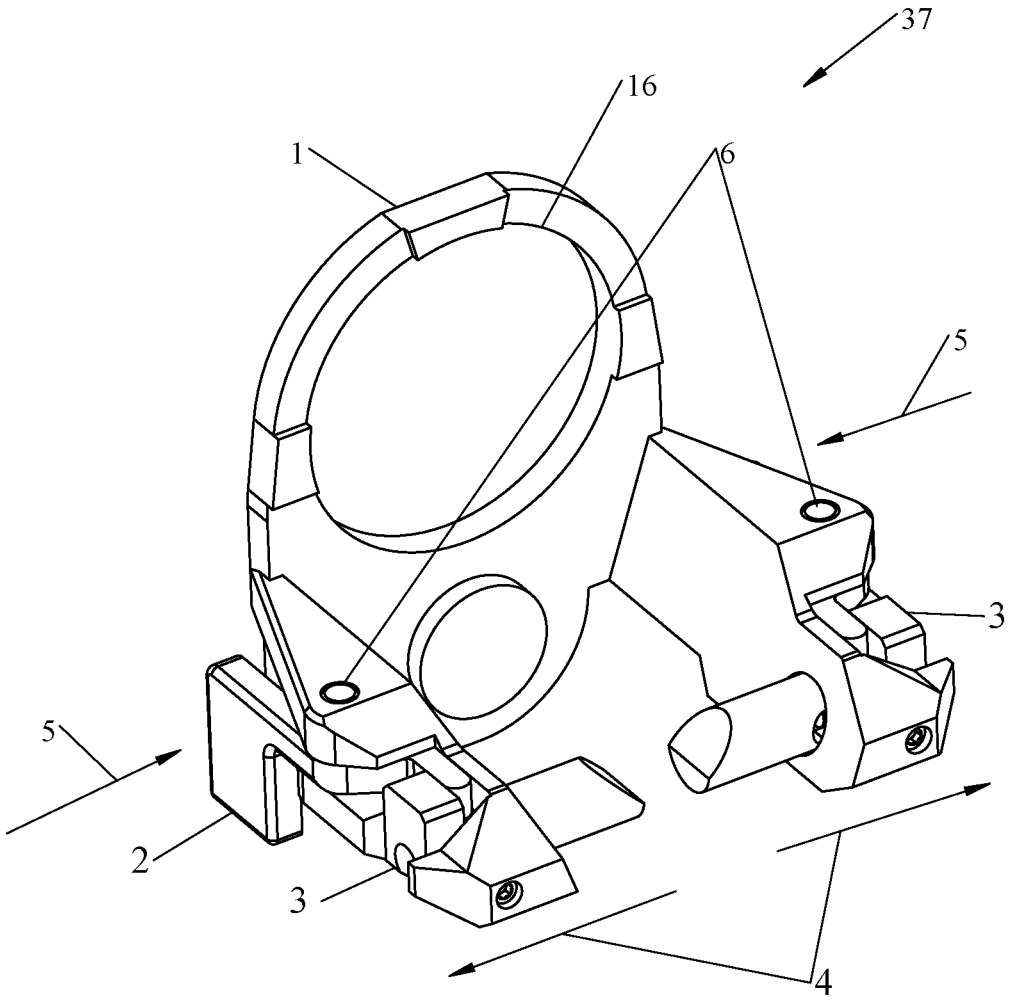
FIG. 1 is an isometric view of the present embodiment.

1. Pin housings main body
2. Paddle
3. Pin
4. Direction of pin movement
5. Direction of paddle movement
6. Dowel pin
7. Spring
8. Set screw
9. Pin holes in housing body
10. Dowel pin hole in main body
11. Dowel pin hole in paddle
12. Set screw slot
13. Spring hole
14. Set screw hole
15. Line of symmetry
16. Buffer tube hole
17. Buffer tube
18. Lower half of the firearm
19. Upper half of the firearm
20. Right side view of a closed firearm
21. Section line A of a firearm
22. Section line B of a firearm
23. Right side view of a closed firearm
24. Section view B of a closed firearm
25. Arrows indicating inward movement of pins
26. Arrows indicating outward movement of pins
27. Arrow indicating upward movement of upper half of a firearm
28. Pin hole of the upper half of firearm
29. Section view C of a firearm open
30. Section line C of a firearm
31. Right side view of an open firearm
32. Arrows indicating inward movement of pins
33. Arrows indicating outward movement of pins
34. Section view A of a firearm closed
35. Chamfer on the pin
36. Bottom of the upper half of firearm
37. Isometric view of assembled sprung weapons pin system
38. Exploded view of sprung weapons pin system
39. Direction of closing of the upper half of a firearm

DETAILED DESCRIPTION OF THE INVENTION

The present invention will now be described in detail with reference to the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Since the basic firearm is of a well-known type, only those parts of the firearm essential to an understanding of the invention will be described in detail. Although the present invention will be described with reference to the exemplary embodiments shown in the drawings, t should be understood that the present invention can be embodied in many alternate forms or embodiments. In addition, any suitable size, shape or type of elements or materials could be used.

The present invention is two spring-loaded pins that are concentric to holes in the upper and lower half of a firearm, that can be moved in and out of holes by pressing on paddles, all held together by a housing fixed to the rear of a firearm. The paddles act as levers that push the two pins away from the center of the assembly when pressure is applied to the paddles. The pins have springs inside them. When pressure is released form the paddles, the springs act on the pins, forcing them back toward the center of the assembly. The pins hold the upper half of a firearm to the lower half of a firearm. When pressure is applied to the paddles, the pins release the upper half of the firearm from the lower half, while stopping in the lower half of the firearms concentric holes. When the two halves of the firearm are separate, and there is no pressure on the paddles, the pins are at rest in the center of the assembly. The pins have angled cuts on the inserting ends of them to allow the upper half of a firearm to be pressed down on to them, this pressure of the upper half of a firearm pushes the pins form the center of the assembly, allowing the upper half of the firearm to come to rest on the lower half of the firearm. When the upper half and lower half of the firearm have come in contact with each other, the sprung pins become aligned concentrically with the hole in the upper half of the firearm and spring into the hole of the upper half of the firearm, rendering the firearm locked closed, until one places pressure on the paddles and moves the pins away from the concentric hole of the upper receiver.

While the aforementioned embodiment would be a preferred embodiment, through the development of this invention there has come many alternate embodiments. One such alternate embodiment, similar to the preferred embodiment, would consist of a single pin, similar to a standard rear takedown pin, that holds the two halves of a weapon together and is retained by a detent pin standard to the weapon its self. This pin would have a pin head that would accommodate a slotted paddle, which could be sprung or un-sprung. The paddle puts a force on the pin in order to remove it from the two halves, the pin would then have to be manually pressed back in to place. The paddle would be anchored to the end plate and or butt plate of the firearm. This design has some merits, but ultimately is inferior because it can be accidentally bumped form one side causing the two halves to release unintentionally, which can be dangerous. This is also an inferior embodiment because the pin needs to be pressed in manually due to the length of the pin needed.

Another alternate embodiment, similar to the preferred embodiment, would consist of two sprung pins acted on by two paddles, sprung or un-sprung, which are mounted to an end plate and or butt plate, whose paddles are joined mechanically, so one could depress a single paddle and it would act on the other paddle, causing both pins to be removed from their holes and release the two halves of a weapon. This alternate embodiment is inferior because the joining of the two paddles mechanically makes the likelihood of accidental release of the two halves, by simply bumping one side, dangerous and more likely.

Yet another alternate embodiment, similar to the preferred embodiment, would incorporate two pins that are acted upon by paddles, sprung or un-sprung, that are mounted in bosses that are molded in to the lower or upper half of the weapon. While this is a good solution for new rifles construction, it is costly to produce and does not create a solution for the already existing weapons on the market.

FIG. 1

Referring now to the present embodiment in more detail, in FIG. 1 shows an isometric view of the present invention 37. The present inventions primary function is to move the two pins 3 in the direction of the arrows 4, by depressing paddles 2, located on either side of the pin housing main body 1, in the direction of the arrows 5. When the paddles 2 are depressed, they pivot about the dowel pin 6. This causes the tip of the paddle 2, opposite the end depressed, to act on the pin 3, which then moves the pins in the direction of the arrows 4. The present invention is attached to a firearm by aligning the pins 3 in the holes where a takedown pin would have previously been located.

FIG. 2

Figure 2:
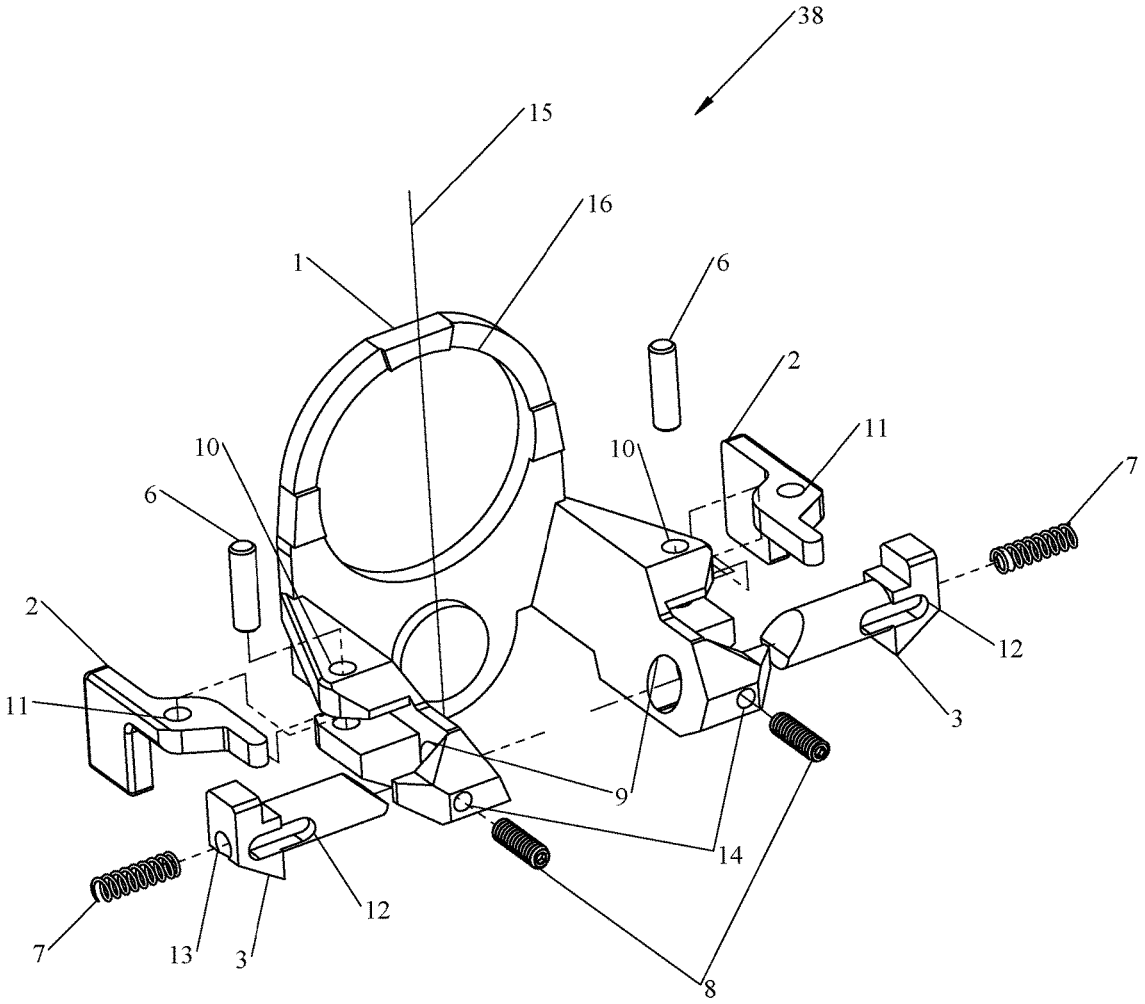
FIG. 2 is an isometric exploded view of the present embodiment.

Referring now to the embodiment in more detail, in FIG. 2 shows an isometric exploded view of the present embodiment 38. The present inventions mechanical function is mirrored about the center of the pins housing main body 1 as represented by the line of symmetry 15. The pin 3 of the present invention is located in the pin holes in the housing body 9 where they move inward toward the center line of the assembly, represented by the line of symmetry 15. The force of the spring 7 is housed in a spring hole 13 in the center of the pin 3. The spring 7 is retained in its spring hole 13 by a set screw 8 that is retained in the set screw hole 14. The set screw 8, protrudes from the set screw hole 14 toward the pin 3. The set screw 8 protrudes from the set screw hole 14 and into the set screws slot 12, located inside the pins 3. The protrusion into the set screw slot 12 will retain the spring 7 in the pin 3. This will keep the pin 3 sprung toward the center of the assembly. The pins 3 of the present invention move away from the center of the assembly by the force of the paddle 2. The paddles 2 are secured to the pin housing main body 1 by dowel pins 6, which the paddles 2 pivot about. The dowel pins 6 are fixed to the pin housing main body 1 after the paddles 2 are aligned with the dowel pin hole in the main body 1 and the dowel pin hole in the paddle 11. The paddle 2 moves freely about the dowel pin 6 because the dowel pin hole in the paddle 11 is a slip fit. The part of the paddle 2 touching the pin 3 acts on the pin 3 with a force that pushes pins 3 from the center of the assembly. The pin housing main body 1 has a buffer tube hole 16 to accommodate a buffer tube 17 to pass through the buffer tube hole 16.

FIG. 3

Figure 3:
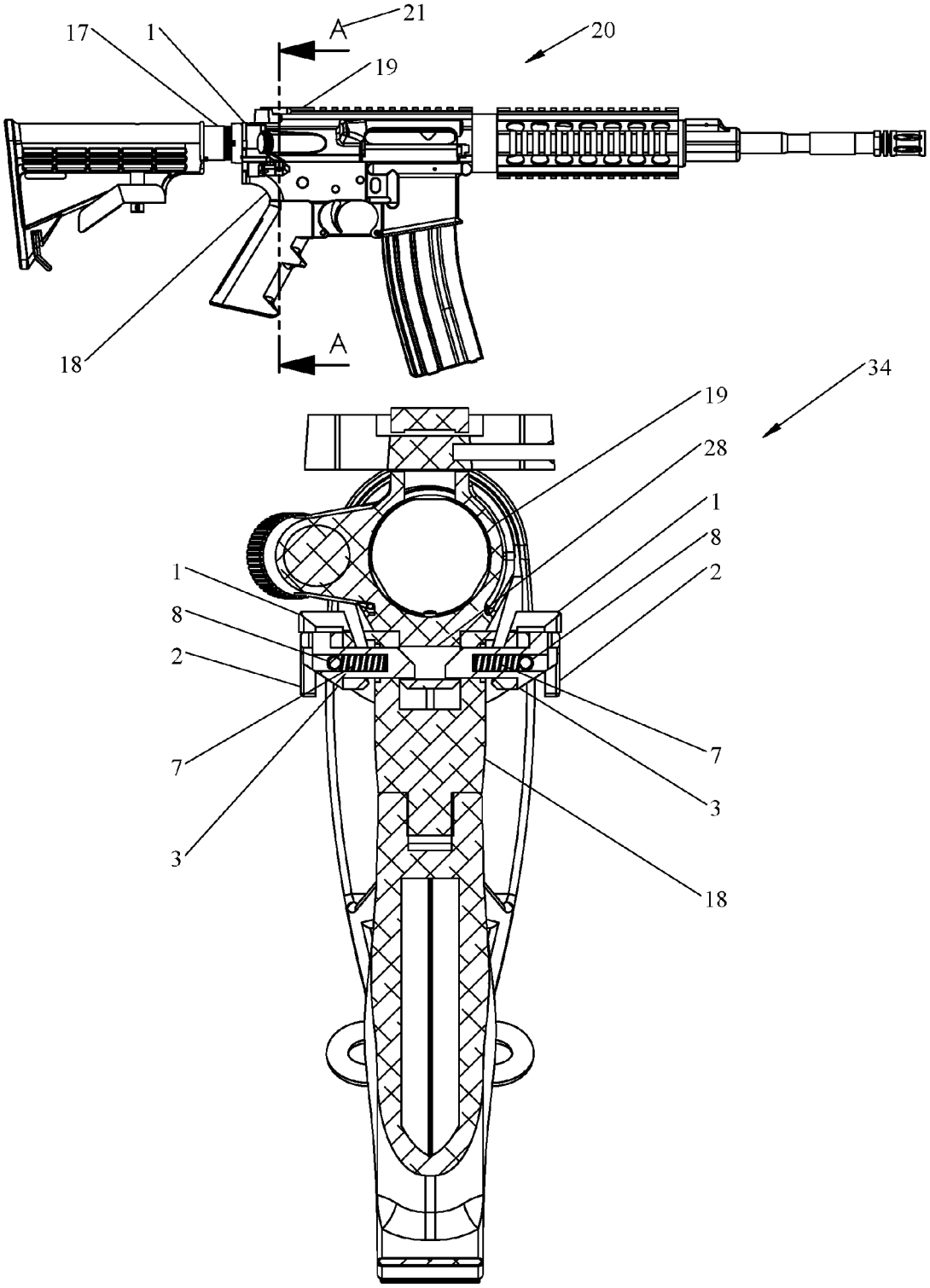
FIG. 3 is a side view and a section view of a closed firearm with the present embodiment installed, having the present embodiment in a closed position.

Referring now to the embodiment in more detail, in FIG. 3, the top of the drawing shows a right side view of a closed firearm 20, including a section cut along the section line A 21. Referring now to the right side view of a closed firearm, still in FIG. 3 of the present embodiment, there is shown a pin housing main body 1 visible at the back of the firearm. The firearms body consists of an upper half 19 and a lower half 18, as well as a buffer tube 17, which is commonly known to individuals with experience and relation to firearms.

Referring now to the section view, still in FIG. 3, shows in the drawing 34, the present invention, attached to a firearm, with the upper half 19 and the lower half 18 of the firearm in the closed position, and the pins 3 of the present invention in the closed position. When the pins 3 are in the closed position, the upper half 19 and the lower half 18 cannot be separated, unless there is pressure applied to the paddles 2, which cause the pins 3 to move away from the center of the assembly, releasing the two halves. The pins 3, when in the closed position shown in FIG. 3, pass through the lower half of a weapon 18 as well as a concentric pin hole of the upper half of the firearm 28, the pins 3 stay held into the upper half 19 of the firearm by the springs 7 retained by set screws 8.

FIG. 4

Figure 4:
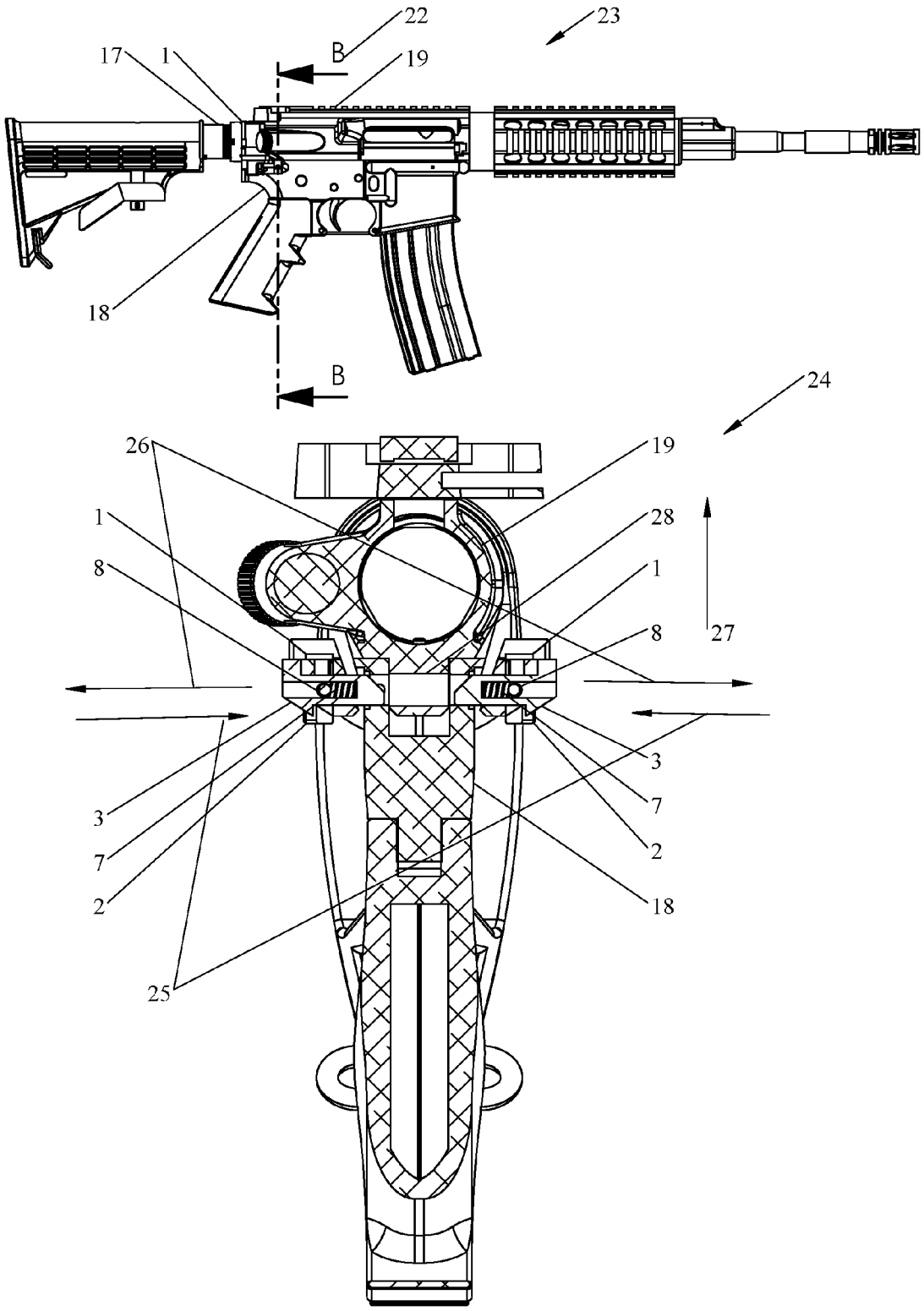
FIG. 4 is a side view and a section view of a closed firearm with the present embodiment installed, having the present embodiment in its open position.

Referring now to the embodiment in more detail, in FIG. 4, shows at the top of the drawing, a right side view of a closed firearm 23, and the section line of a firearm 22 that is cut through the center of this embodiment's pins 3. Below the right side view of a closed firearm 23 there is shown a section view B of a closed firearm 24, in which the present embodiment is in the open position, where the paddles 2 are depressed, which causes the pins 3 to move away from the center of the assembly and compresses the springs 7 on the set screws 8. Removing the pins 3 form the upper half of the firearm 19 and the pin hole of the upper half of the firearm 28. The upper half of the firearm 19 is now free to separate away from the lower half of the firearm 18 without the restriction previously held by the pins 3. When the upper half of the firearm 19 is moved away from the lower half of the firearm 18, and pressure is released form the present embodiment's paddles 2, the pins 3 will automatically move toward the center of the assembly because of the energy of the springs 7 held in place by the set screws 8.

FIG. 5

Referring now to the embodiment in more detail, drawing shows of a right side view of an open firearm 31. Showing in that view is a section line C of a firearm 29. That section line cuts through the center of the present embodiment's pins 3.

Figure 5:
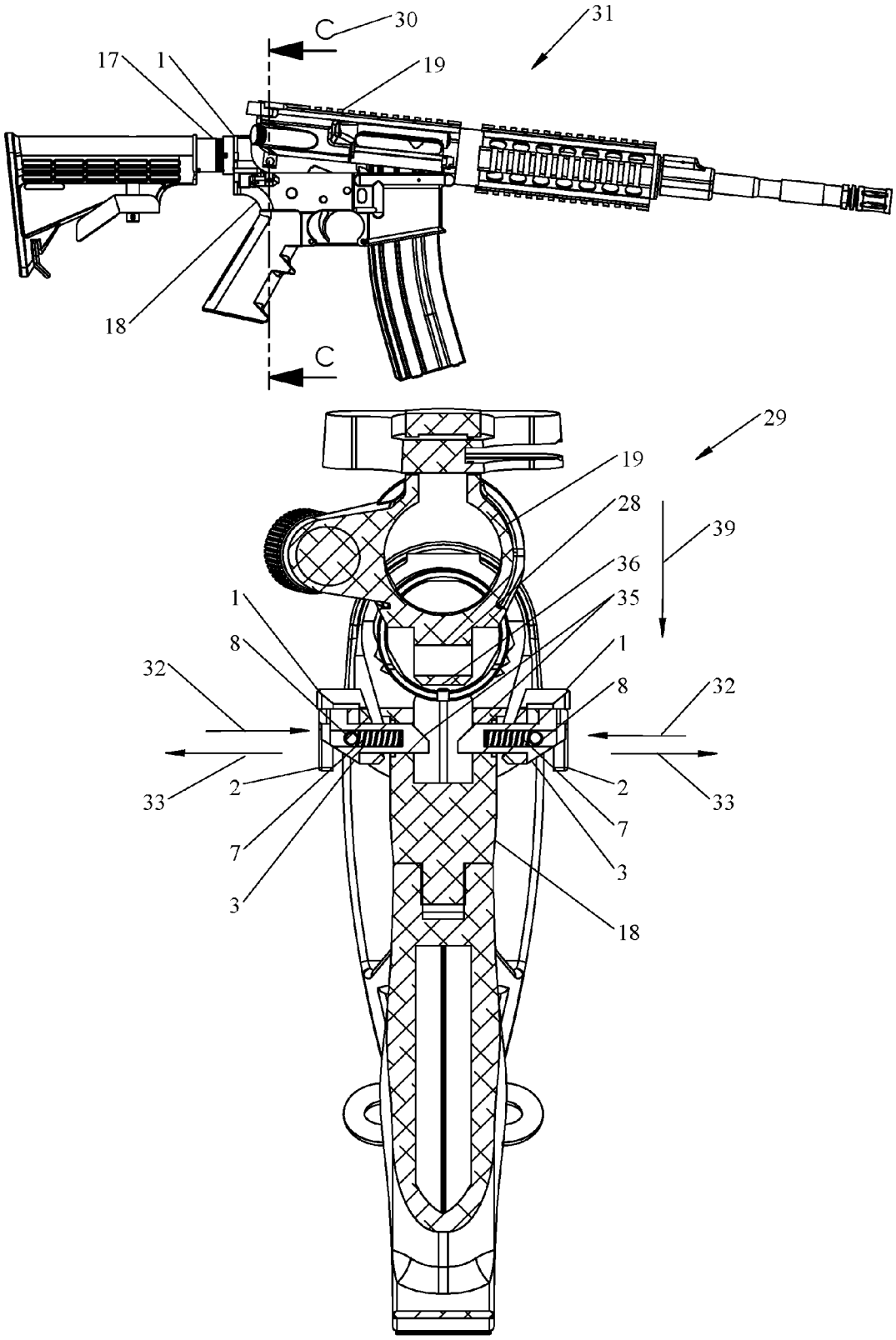
FIG. 5 is a side view and a section view of an open firearm with the present embodiment installed, having the present embodiment in a closed position.

More specifically now, referring to FIG. 5 and the section drawing C of an open firearm 29, the upper half of a firearm 19 is above the lower half of a firearm 18, when pressed downward, as shown by arrow 39, the upper half of a firearm 19 will come in contact with the present embodiment's pins 3. The bottom of the upper half of a firearm 36 will contact a chamfer on the pins 35, and when the direction of the closing of the upper half of a firearm 39 contacts the chamber on the pins 35, the pins 3 will be forced out of the path of the upper half of a firearm 19. The spring 7 in the pins 3 of the present embodiment will then fall into the pin hole of the upper half of the firearm 28, moving inward toward the center of the assembly, indicated by the arrows showing the inward movement of pins 3. The closing of the upper half of a firearm 19 as indicated by the direction of the closing of the upper half of a firearm 39 will then position the upper half of a firearm 19 and lower half of a firearm 18, into a closed and locked position, as shown in the aforementioned drawing of a section view of a firearm closed 34 in FIG. 3.

ADVANTAGES

The advantages of the present invention include, without limitation, the easy release of the upper half of a firearm from the lower half by firmly pressing the paddles. The additional advantage is that the pins spring in when closing the upper receiver to the lower, locking the firearm closed without further action. The advantage of pressing the paddles to release the pins is great, compared to the prior method of pin removal which involved a tool, or pulling a ring a greater distance, all of which took more time and effort for the separation of the upper and lower halves of a firearm. The closing of the upper and lower receiver is much faster and requires less effort that the previous method as well, where in the past one would have to press a pin in by force, with one's hand or tool, while holding both halves of the firearm.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

What is claimed is:

1. A sprung pin assembly for assembly and disassembly of a firearm, comprising:

a pin housing main body;

spring loaded pins; and paddles;

the pin housing main body having pin holes for inserting spring loaded pins, dowel pin holes for attaching the paddles and a buffer hole to accommodate a buffer tube, an upper half and a lower half of the firearm is secured in a releasable pivotal assembly by the spring loaded pins and the spring loaded pins are locked in the assembly by set screws, the spring loaded pins are concentric to holes in the upper half and the lower half of the firearm, an inserting end of the pins are angled cut to allow the upper half to be pressed down while in face-to-face engagement to the lower half of the firearm, and simultaneously the upper half pushes the spring loaded pins that are inserted into the lower half, thereby allowing the upper half to come to rest on the lower half of the firearm, and the paddles push the spring loaded pins outwardly from the pin housing main body when pressure is applied to the paddles; the paddles are secured to the pin housing main body and manually operated in assembly and disassembly of the firearm.

2. The sprung pin assembly of claim 1, wherein the assembly of the upper half into the lower half of the firearm is achieved by releasing pressure form the paddles, that simultaneously act reverse force on the spring loaded pins, the spring loaded pins are inserted into the upper half and the lower half of the firearm.

3. The sprung pin assembly of claim 1, wherein the disassembly of the upper half from the lower half of the firearm is achieved by applying pressure on the paddles to release the spring loaded pins outwardly from the pin housing main body, simultaneously disassembling the upper half from the lower half of the firearm.

4. The sprung pin assembly of claim 1, wherein the pin housing main body comprising:

an arrangement having a left pin hole and a right pin hole for inserting first spring loaded pin in the left pin hole and a second spring loaded pin in the right pin hole;

similarly an arrangement having a left dowel pin hole and a right dowel pin hole for attaching a first paddle in the left dowel pin hole and a second paddle in the right dowel pin hole by dowel pins; and the buffer hole is common to both the upper half and lower half of the fire arm, and disposed at least partially within an opening.

5. The sprung pin assembly of claim 1, wherein the spring loaded pins comprising:

pin; and spring;

wherein the spring loaded pins are inserted into the pin housing main body for securing the upper half and the lower half of the firearm and the spring loaded pins are locked in the assembly by set screws.

6. The sprung pin assembly of claim 1, wherein there are two paddles, a first paddle attached on a left side and a second paddle attached on a right side of the pin housing main body; further the paddles are secured to the pin housing main body by the dowel pins.

7. The sprung pin assembly of claim 1, wherein the paddles act as levers that push the spring loaded pins outwardly from the pin housing main body when pressure is applied to the paddles.

8. The sprung pin assembly of claim 4, wherein the dowel pins are inserted to the pin housing main body after the paddles are aligned with the dowel pin holes in the pin housing main body and the dowel pin holes in the paddles.

9. The sprung pin assembly of claim 8, wherein the dowel pin holes in the paddles are a slip fit, whereby the paddles move freely about the dowel pins.

10. A sprung pin assembly of claim 1, wherein the spring loaded pins having angled cuts on the inserting ends to allow the upper half to be pressed down while in face-to-face engagement to the lower half, and simultaneously the upper half pushes the spring loaded pins that are inserted into the lower half, thereby allowing the upper half to come to rest on the lower half of the firearm.

11. A sprung pin assembly of claim 1, wherein the spring loaded pins are moved in and out of the pin holes by applying pressure on the paddles.

12. A sprung pin assembly for assembly and disassembly of a firearm, comprising:

a pin housing main body;

spring loaded pins; and paddles;

wherein a upper half and a lower half of the firearm is secured in a releasable pivotal assembly by the spring loaded pins and the spring loaded pins are locked in the assembly by set screws, wherein the spring loaded pins are moved in and out of the pin holes on the pin housing main body the by applying pressure on the paddles, and wherein the paddles push the spring loaded pins outwardly from the pin housing main body when pressure is applied to the paddles, the paddles are secured to the pin housing main body and manually operated in assembly and disassembly of the firearm.

13. A sprung pin assembly of claim 12, wherein the spring loaded pins having angled cuts on an inserting ends to allow the upper half to be pressed down while in face-to-face engagement to the lower half, and simultaneously the upper half pushes the spring loaded pins that are inserted into the lower half, thereby allowing the upper half to come to rest on the lower half of the firearm.

14. The sprung pin assembly of claim 12, wherein the assembly of the upper half into the lower half of the firearm is achieved by releasing pressure from the paddles, that simultaneously act reverse force on the spring loaded pins, the spring loaded pins are inserted into the upper half and the lower half of the firearm.

15. The sprung pin assembly of claim 12, wherein the disassembly of the upper half from the lower half of the firearm is achieved by applying pressure on the paddles to release the spring loaded pins outwardly from the pin housing main body, simultaneously disassembling the upper half from the lower half of the firearm.

16. A sprung pin assembly for assembly and disassembly of a firearm, consisting of:

a pin housing main body;

spring loaded pins; and paddles;

the pin housing main body consist of first arrangement having a left pin hole and a right pin hole for inserting a first spring loaded pin in the left pin hole and a second spring loaded pin in the right pin hole, and a second arrangement having a left dowel pin hole and a right dowel pin hole for attaching first paddle in the left dowel pin hole and second paddle in the right dowel pin hole by dowel pins, and a buffer hole to accommodate a buffer tube, the buffer hole is common to both the upper half and lower half of the fire arm, and disposed at least partially within an opening, the spring loaded pins consist of pin and spring, wherein the spring loaded pins are inserted into the pin housing main body for securing the upper half and the lower half of the firearm, wherein the upper half and the lower half of the firearm is secured in a releasable pivotal assembly by the spring loaded pins and the spring loaded pins are locked in the assembly by set screws, wherein the spring loaded pins are moved in and out of the pin holes on the pin housing main body by applying pressure on the paddles, wherein the paddles push the spring loaded pins away from the assembly when pressure is applied to the paddles, the paddles are secured to the pin housing main body and manually operated in assembly and disassembly of the firearm.

17. The sprung pin assembly of claim 16, wherein the spring loaded pins are concentric to holes in the upper and lower half of a firearm.

18. The sprung pin assembly of claim 16, wherein the assembly of the upper half into the lower half of the firearm is achieved by releasing pressure form the paddles, that simultaneously act reverse force on the spring loaded pins, the spring loaded pins are inserted into the upper half and the lower half of the firearm.

19. The sprung pin assembly of claim 16, wherein the disassembly of the upper half from the lower half of the firearm is achieved by applying pressure on the paddles to release the spring loaded pins outwardly from the pin housing main body, simultaneously disassembling the upper half from the lower half of the firearm.

20. A sprung pin assembly of claim 16, wherein the spring loaded pins having angled cuts on the inserting ends to allow the upper half to be pressed down while in face-to-face engagement to the lower half, and simultaneously the upper half pushes the spring loaded pins that are inserted into the lower half, thereby allowing the upper half to come to rest on the lower half of the firearm.

* * * * *